US007358708B2

(12) United States Patent
Jiang et al.

(10) Patent No.: US 7,358,708 B2
(45) Date of Patent: Apr. 15, 2008

(54) LINEAR VOLTAGE REGULATOR

(75) Inventors: Wu Jiang, Shenzhen (CN); Yong-Zhao Huang, Shenzhen (CN); Yun Li, Shenzhen (CN)

(73) Assignees: Hong Fu Jin Precision Industry (Shenzhen) Co., Ltd., Bao-an District, Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 175 days.

(21) Appl. No.: 11/283,287

(22) Filed: Nov. 17, 2005

(65) Prior Publication Data

US 2006/0103361 A1 May 18, 2006

(30) Foreign Application Priority Data

Nov. 18, 2004 (CN) ..... 2004 1 0052366

(51) Int. Cl.
*G05F 1/56* (2006.01)

(52) U.S. Cl. ..... 323/273; 323/280

(58) Field of Classification Search ..... 323/282–288, 323/273, 280, 279, 351, 290
See application file for complete search history.

(56) References Cited

U.S. PATENT DOCUMENTS

| | | | | |
|---|---|---|---|---|
| 5,689,179 | A | 11/1997 | Walker | |
| 5,864,226 | A | 1/1999 | Wang et al. | |
| 6,198,262 | B1 * | 3/2001 | Squibb et al. | 323/273 |
| 6,861,901 | B2 | 3/2005 | Prexl et al. | |

* cited by examiner

*Primary Examiner*—Rajnikant B. Patel
(74) *Attorney, Agent, or Firm*—Morris Manning Martin LLP; Tim Tingkang Xia, Esq.

(57) ABSTRACT

A linear voltage regulator provides a regulated load voltage to a load. In a preferred embodiment, the linear voltage regulator includes: a regulating circuit for receiving an input voltage and providing an output voltage to a load, the regulating circuit being driven by a driving voltage; and two resistors connected to each other in series receiving the output voltage and providing an adjusting current to the regulating circuit. The linear voltage regulator is capable of providing a greater current to the load, and having a wide range of input voltages.

15 Claims, 2 Drawing Sheets

LINEAR VOLTAGE REGULATOR

BACKGROUND OF THE INVENTION

1. Field of the Invention

The present invention relates to voltage regulators, and particularly to a linear voltage regulator for providing a regulated voltage to a load mounted on a motherboard.

2. General Background

Linear voltage regulators are widely used to supply power to electronic devices, such as to a load on a motherboard of a computer. Such linear voltage regulators are available in a wide variety of configurations for many different applications.

Referring to FIG. 3, a typical linear voltage regulator 1 includes a voltage regulator IC (Integrated Circuit) 10. The voltage regulator IC 10 includes an adjusting terminal 11, an input terminal 12, and an output terminal 13. The adjusting terminal 11 receives an adjusting voltage $V_1$. The input terminal 12 receives an input voltage $V_{in}$, and is grounded via a first filter capacitor $C_1$. The output terminal 13 provides an output voltage $V_{out}$ to a load $R_L$, and is grounded via a second filter capacitor $C_2$. Two resistors $R_1$ and $R_2$ are connected to each other in series, between the output terminal 13 and ground. A node N between the resistors $R_1$ and $R_2$ provides the adjusting voltage $V_1$ to the adjusting terminal 11.

An impedance of each of the resistors $R_1$, $R_2$ is adjustable. When the resistor $R_1$ or the resistor $R_2$ has an appropriate impedance, the output voltage $V_{out}$ can be regulated at a required level.

However, in the voltage regulator IC 10, when the input voltage $V_{in}$ is 3.3V and the output voltage $V_{out}$ is 1.5V, a load current is less than 0.1 A. Therefore the linear voltage regulator 1 cannot provide a greater current to the load. Furthermore, in the voltage regulator IC 10, a difference between the input voltage $V_{in}$ and the output voltage $V_{out}$ is between 1.3V and 1.5V. Therefore when a 1.5V output voltage $V_{out}$ is needed, the input voltage $V_{in}$ must be between 2.8V (i.e., 1.5V+1.3V) and 3.0V (i.e., 1.5V+1.5V). Otherwise, the linear voltage regulator 1 will not run properly.

What is needed, therefore, is a linear voltage regulator which is able to provide a greater current to a load and have a wide range of input voltages.

SUMMARY

A linear voltage regulator is provided for providing a regulated load voltage to a load. In a preferred embodiment, the linear voltage regulator includes: a regulating circuit for receiving an input voltage and providing an output voltage to a load, the regulating circuit being driven by a driving voltage; and two resistors connected to each other in series receiving the output voltage and providing an adjusting current to the regulating circuit. Since a MOSFET is adopted as a regulating means, the load current of the linear voltage regulator is much higher than that of the conventional linear voltage regulator. Due to the regulating means being driven by the driving voltage, the output voltage is independent of the input voltage. Therefore the output voltage is stabilized at about 1.5V when the input voltage is varying within a wide range between about 1.5V and 7.0V.

The linear voltage regulator is capable of providing a greater current to the load, and having a wide range of input voltages.

Other advantages and novel features will become more apparent from the following detailed description of preferred embodiments when taken in conjunction with the accompanying drawings, in which:

DETAILED DESCRIPTION OF THE EMBODIMENTS

Figure 1:
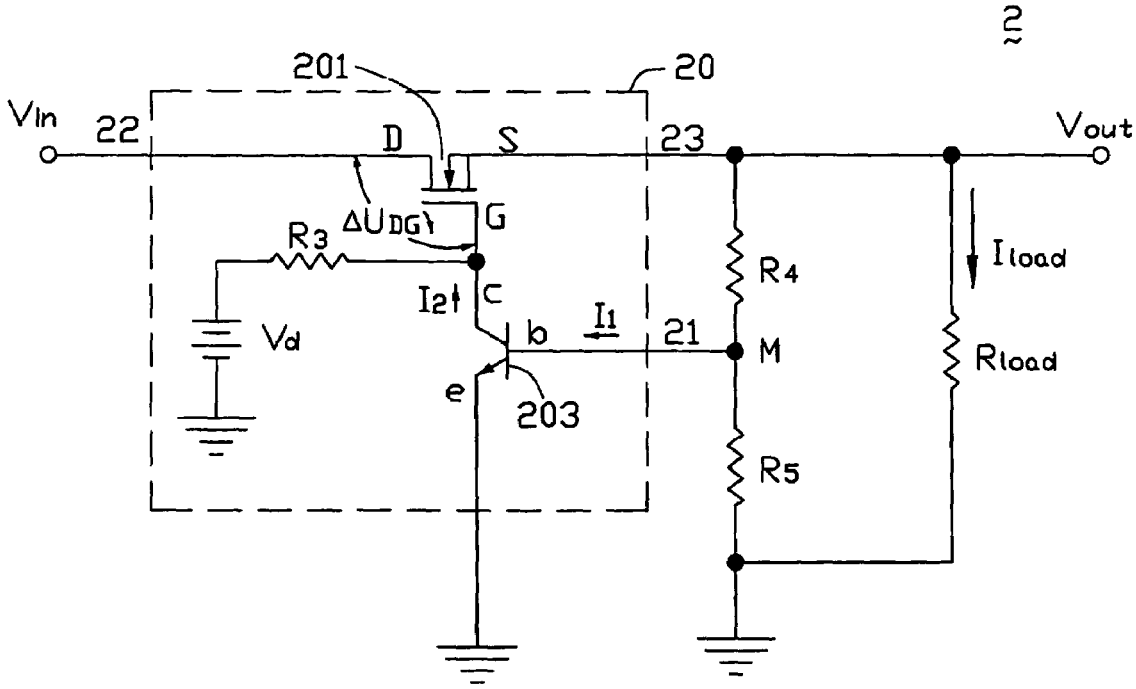
FIG. 1 is a circuit diagram of a linear voltage regulator of a first preferred embodiment of the present invention.

As shown in FIG. 1, in a first preferred embodiment of the present invention, a linear voltage regulator 2 includes a regulating circuit 20. The regulating circuit 20 includes an adjusting terminal 21, an input terminal 22, and an output terminal 23. The adjusting terminal 21 receives an adjusting current $I_1$. The input terminal 22 receives an input voltage $V_{in}$. The output terminal 23 provides an output voltage $V_{out}$ to a load $R_{load}$. A resistive voltage divider (not labeled) comprises two resistors $R_4$ and $R_5$. The resistors $R_4$ and $R_5$ are connected to each other in series, between the output terminal 23 and ground. A node M between the resistor $R_4$ and the resistor $R_5$ provides the adjusting current $I_1$.

The regulating circuit 20 includes a regulating means 201, a transistor amplifier 203, and a current-limiting resistor $R_3$. The regulating means 201 is an N-channel metal-oxide-semiconductor field-effect transistor (MOSFET). The transistor amplifier 203 is a bipolar transistor. A base of the transistor amplifier 203 receives the adjusting current $I_1$. An emitter of the transistor amplifier 203 is grounded. A collector of the transistor amplifier 203 is connected to a gate of the regulating means 201. The gate of the regulating means 201 as a controlling pole is coupled to a driving voltage $V_d$ via a current-limiting resistor $R_3$. A drain of the regulating means 201 as an input pole is connected to the input terminal 22 for receiving the input voltage $V_{in}$. A source of the regulating means 201 as an output pole is connected to the output terminal 23 for providing the output voltage $V_{out}$.

When an output voltage $V_{out}$ suddenly becomes higher, the adjusting current $I_1$ becomes larger correspondingly. A collector current $I_2$ becomes larger correspondingly. Then a voltage $\Delta U_{DG}$ between the gate and the source of the regulating means 201 becomes higher. The increase of the voltage $\Delta U_{GS}$ induces a decrease of the output voltage $V_{out}$. Therefore the load voltage $V_{load}$ drops to a same level as before the sudden increase thereof.

Contrarily, when the output voltage $V_{out}$ suddenly becomes lower, the adjusting current $I_1$ becomes smaller correspondingly. The collector current $I_2$ becomes smaller correspondingly. Then the voltage $U_{DG}$ between the gate and the source of the regulating means 201 becomes lower. The decrease of the voltage $\Delta U_{DG}$ induces an increase of the output voltage $V_{out}$. Therefore the load voltage $V_{load}$ climbs to a same level as before the sudden decrease thereof.

In the illustrated embodiment, because that the regulating means 201 is driven by the driving voltage $V_d$ instead of the input voltage $V_{in}$, a change of the input voltage $V_{in}$ cannot influence the conduction capability of the regulating means 201. Therefore the linear voltage regulator 2 can have a wide range of the input voltage $V_{in}$. Because the regulating means

201 can have a greater current, the linear voltage regulator 2 can provide a greater current. Furthermore, since the input voltage $V_{in}$ can be reduced, a power of the linear voltage regulator 2 can be reduced correspondingly.

A relationship of an impedance of the load $R_{load}$, the input voltage $V_{in}$ and the output voltage $V_{out}$ is shown as follows:

1) When the input voltage $V_{in}$ and the driving voltage $V_d$ are invariable. As an example, the input voltage $V_{in}$ is 3.3V, and the driving voltage $V_d$ is 3.3V. In such case, a relationship of the impedance of the load $R_{load}$ and the output voltage $V_{out}$ is shown as follows:

TABLE 1

Relationship between Impedance of Load and Output Voltage

| Impedance of load $R_{load}$ (Ω) | Output voltage $V_{out}$ (V) |
|---|---|
| . . . | . . . |
| 8.5 | 1.508 |
| 12.3 | 1.514 |
| 13.2 | 1.515 |
| 15.3 | 1.515 |
| 19.2 | 1.517 |
| 19.7 | 1.518 |
| 24.6 | 1.519 |
| 29.7 | 1.521 |
| 30.5 | 1.522 |
| 38.6 | 1.523 |
| 43.6 | 1.525 |
| 47.5 | 1.525 |
| 52.8 | 1.526 |
| 58.1 | 1.526 |
| 61.4 | 1.526 |
| . . . | . . . |

Figure 3:
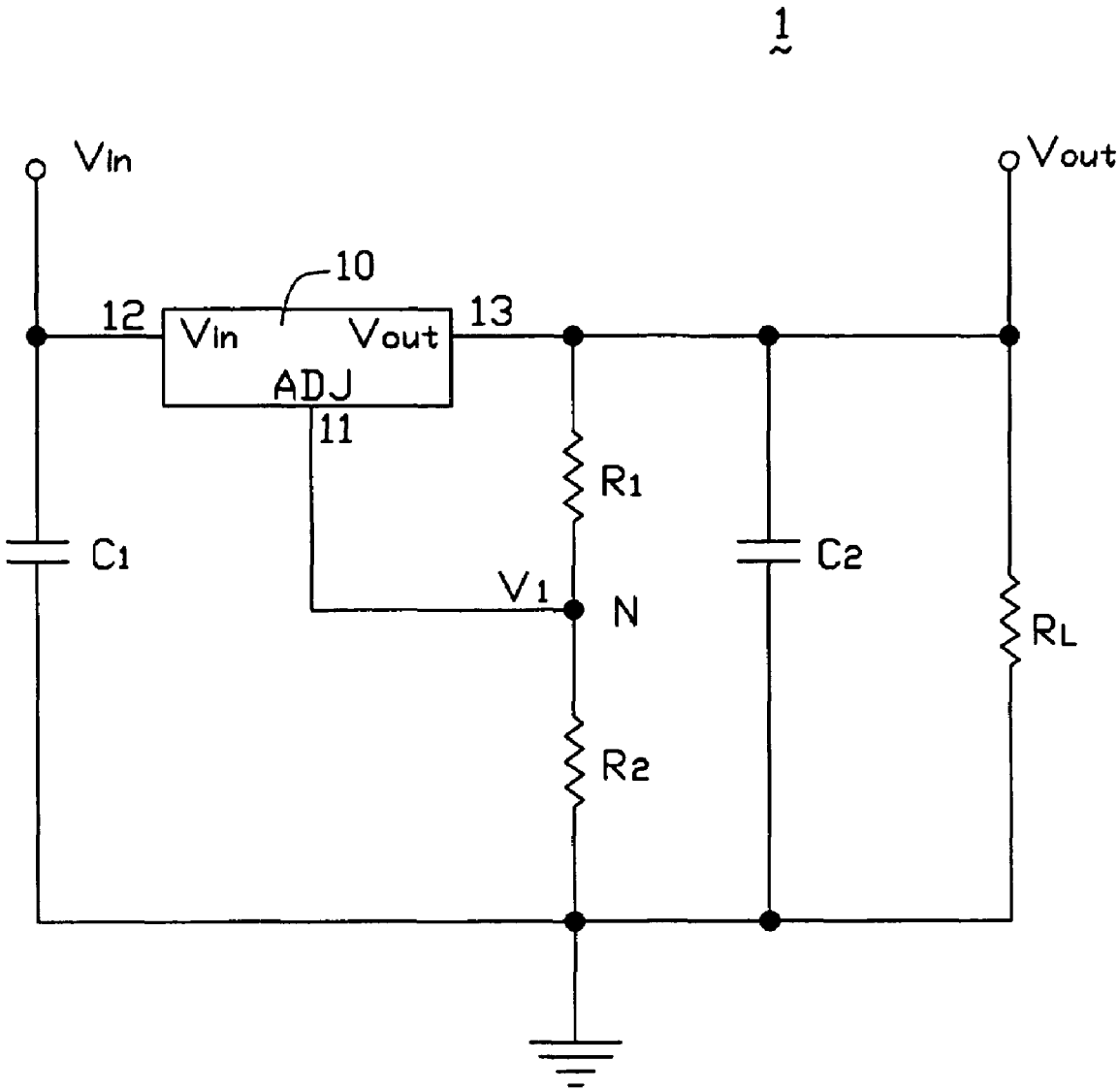
FIG. 3 (PRIOR ART)
FIG. 3 is a circuit diagram of a typical linear voltage regulator.

As seen in TABLE 1, the output voltage $V_{out}$ is stabilized at about 1.5V. Furthermore, since a MOSFET is adopted as the regulating means 201, a 5.2 A load current $I_{load}$ is gained. Compare this with the conventional linear voltage regulator 1 (see FIG. 3), wherein when the input voltage $V_{in}$ is 3.3V and the output voltage $V_{out}$ is stabilized at about 1.5V, the load current $I_{load}$ is less than 0.1 A. The load current $I_{load}$ of the linear voltage regulator 2 is as much as 52 times (or more) higher than that of the conventional linear voltage regulator 1.

2) When the impedance of the load $R_{load}$ and the driving voltage $V_d$ are invariable. As an example, the impedance of the load $R_{load}$ is 100 Ω, and the driving voltage $V_d$ is 3.3V. In such case, a relationship of the input voltage $V_{in}$ and the output voltage $V_{out}$ is shown as follows:

TABLE 2

Relationship between Input Voltage and Output Voltage

| Input voltage $V_{in}$ (V) | Output voltage $V_{out}$ (V) |
|---|---|
| . . . | . . . |
| 1.505 | 1.488 |
| 1.6 | 1.512 |
| 1.7 | 1.512 |
| 1.8 | 1.512 |
| 2 | 1.512 |
| 2.5 | 1.512 |
| 3 | 1.512 |
| 3.6 | 1.512 |
| 3.8 | 1.512 |
| 4 | 1.513 |
| 4.8 | 1.513 |
| 5.7 | 1.513 |
| 6.2 | 1.513 |

TABLE 2-continued

Relationship between Input Voltage and Output Voltage

| Input voltage $V_{in}$ (V) | Output voltage $V_{out}$ (V) |
|---|---|
| 6.7 | 1.513 |
| 7 | 1.513 |
| . . . | . . . |

As seen in TABLE 2, due to the regulating means 201 being driven by the driving voltage $V_d$, the output voltage $V_{out}$ is independent of the input voltage $V_{in}$. Therefore the output voltage $V_{out}$ is stabilized at about 1.5V when the input voltage $V_{in}$ is varying within a wide range between about 1.5V and 7.0V.

Figure 2:
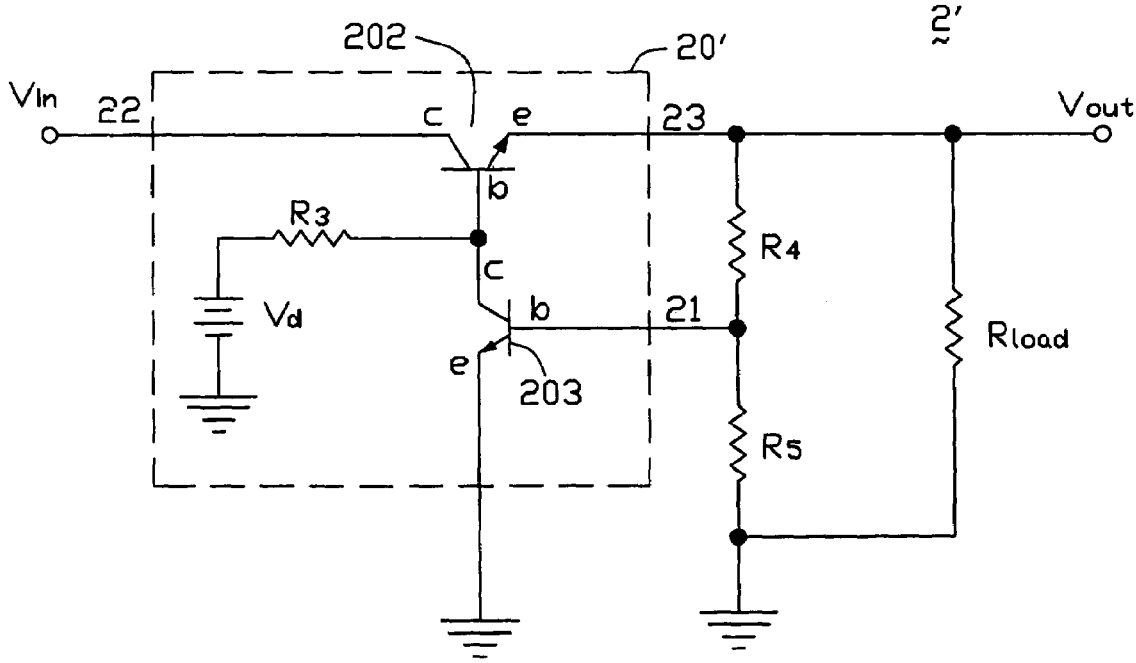
FIG. 2 is a circuit diagram of a linear voltage regulator of a second preferred embodiment of the present invention.

As shown in FIG. 2, in a second preferred embodiment of the present invention, instead of having a regulating circuit 20, a linear voltage regulator 2' of the second preferred embodiment has a regulating circuit 20'. The regulating circuit 20' includes a regulating means 202. The regulating means 202 is a bipolar transistor. A base of the regulating means 202 as a controlling pole is connected to the transistor amplifier 203, and receives the driving voltage $V_d$. A collector of the regulating means 202 as an input pole is connected to the input terminal 22 for receiving the input voltage $V_{in}$. An emitter of the regulating means 202 as an output pole is connected to the output terminal 23 for providing the output voltage $V_{out}$.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A linear voltage regulator comprising:

a regulating circuit for receiving an input voltage and providing an output voltage to a load, the regulating circuit comprising a regulating means and a transistor amplifier, the regulating means comprising a controlling pole, an input pole, and an output pole, and the transistor amplifier comprising a base, an emitter, and a collector; and two resistors connected to each other in series for receiving the output voltage and providing an adjusting current to the regulating circuit, wherein the base of the transistor amplifier receives the adjusting current, the emitter of the transistor amplifier is grounded, the collector of the transistor amplifier is connected to the controlling pole, the controlling pole receives a driving voltage, instead of the input voltage, for driving the regulating means so that a change in the input voltage cannot influence the conduction capability of the regulating means, the input pole receives the input voltage, and the output pole provides the output voltage.

2. The linear voltage regulator as claimed in claim 1, wherein the transistor amplifier is a bipolar transistor.

3. The linear voltage regulator as claimed in claim 1, wherein the regulating means is a MOSFET (metal-oxide-semiconductor field-effect transistor), the controlling pole is a gate of the regulating means, the input pole is a drain of the regulating means, and the output pole is a source of the regulating means.

4. The linear voltage regulator as claimed in claim 1, wherein the regulating means is a bipolar transistor, the controlling pole is a base of the regulating means, the input pole is a collector of the regulating means, and the output pole is an emitter of the regulating means.

5. The linear voltage regulator as claimed in claim 1, wherein the input voltage is 3.3V.

6. The linear voltage regulator as claimed in claim 1, wherein the output voltage is 1.5V.

7. A linear voltage regulator comprising:

a regulating means comprising a controlling pole, an input pole and an output pole, the input pole receiving an input voltage, the output pole providing an output voltage, the controlling pole receiving a driving voltage, instead of the input voltage, for driving the regulating means so that a change in the input voltage cannot influence the conduction capability of the regulating means;

a transistor amplifier including a base receiving an adjusting current, an emitter being grounded, and a collector being connected to the controlling pole; and a resistive voltage divider receiving the output voltage and providing the adjusting current to the base.

8. The linear voltage regulator as claimed in claim 7, wherein the resistive voltage divider comprises two resistors, the resistors are connected to each other in series between the output pole and ground, and a node between the resistors provides the adjusting current to the base.

9. The linear voltage regulator as claimed in claim 7, wherein the regulating means is an N-channel MOSFET (metal-oxide-semiconductor field-effect transistor), the controlling pole is a gate of the regulating means, the input pole is a drain of the regulating means, and the output pole is a source of the regulating means.

10. The linear voltage regulator as claimed in claim 7, wherein the regulating means is a bipolar transistor, the controlling pole is a base of the regulating means, the input pole is a collector of the regulating means, and the output pole is an emitter of the regulating means.

11. The linear voltage regulator as claimed in claim 7, wherein the input voltage is 3.3V.

12. The linear voltage regulator as claimed in claim 7, wherein the output voltage is 1.5V.

13. A voltage regulator comprising:

a regulating means capable of accepting an input voltage and generating an output voltage under control of a driving voltage independent from said input voltage;

an amplifier electrically connected with said regulating means and capable of accepting an electrical current caused by said output voltage of said regulating means so as to control said regulating means together with said driving voltage.

14. The voltage regulator as claimed in claim 13, wherein said regulating means is a selective one of a metal-oxide-semiconductor field-effect transistor (MOSFET) and a bipolar transistor.

15. The voltage regulator as claimed in claim 13, further comprising a voltage divider electrically connected between said regulating means and amplifier so as to generate said electrical current for said amplifier based on said output voltage of said regulating means.

* * * * *